United States Patent [19]

Jacobson et al.

[11] Patent Number: 4,688,283

[45] Date of Patent: Aug. 25, 1987

[54] MATTRESS WHICH CONFORMS TO BODY PROFILE

[76] Inventors: Theodore L. Jacobson, 1237 Chestnut St. #4, San Francisco, Calif. 94109-1048; Charles P. Hall, 5815 Bennett Valley Rd., Conoma County, Santa Rosa, Calif. 95404

[21] Appl. No.: 810,850

[22] Filed: Dec. 23, 1985

Related U.S. Application Data

[63] Continuation of Ser. No. 542,763, Oct. 17, 1983, abandoned.

[51] Int. Cl.[4] ..... A47C 27/08; A47C 27/10

[52] U.S. Cl. ..... 5/449; 5/455; 5/450

[58] Field of Search ..... 5/441, 449, 450, 455, 5/417, 420; 297/DIG. 3, 114, 118

[56] References Cited

U.S. PATENT DOCUMENTS

| | | | |
|---|---|---|---|
| 1,045,228 | 11/1912 | Weltmer | 5/36 |
| 1,777,477 | 10/1930 | Sampson | 5/449 |
| 2,069,422 | 2/1937 | Sampson | 5/449 |
| 2,843,181 | 7/1958 | Paschen | 5/441 |
| 2,997,100 | 8/1961 | Morris . | |
| 3,378,864 | 4/1968 | Cornes . | |
| 3,583,008 | 5/1971 | Edwards . | |
| 3,653,083 | 4/1972 | Lapidus | 5/450 |
| 3,822,425 | 7/1974 | Scales . | |
| 3,842,455 | 10/1974 | Whitney . | |
| 3,959,835 | 5/1976 | Nos . | |
| 3,984,886 | 10/1976 | Keeton | 5/455 |
| 4,025,974 | 5/1977 | Lea et al. . | |
| 4,054,960 | 6/1977 | Pettit et al. . | |
| 4,120,061 | 10/1978 | Clark . | |
| 4,134,166 | 1/1979 | Schuder . | |
| 4,139,920 | 2/1979 | Evans | 5/448 |
| 4,148,521 | 4/1979 | Van Hook | 5/449 |
| 4,234,982 | 11/1980 | Bez et al. | 5/449 |
| 4,340,626 | 7/1982 | Rudy | 5/449 |
| 4,383,342 | 5/1983 | Forster | 5/448 |
| 4,405,129 | 9/1983 | Stuckey | 5/449 |

FOREIGN PATENT DOCUMENTS

| | | | |
|---|---|---|---|
| 228752 | 6/1960 | Australia | 47/7 |

*Primary Examiner*—Gary L. Smith
*Assistant Examiner*—Vinh Luong
*Attorney, Agent, or Firm*—David Pressman

[57] ABSTRACT

A mattress or pad that contours and conforms to the body profile of a reclining individual. The preferred embodiments contain flexible, airtight chambers, at least two of which are interconnected to allow the transfer of air or liquid. Interconnected chambers are positioned and dimensioned to conform to and support the natural curves of a reclining body. The volume of fluid, e.g., air or liquid, within all of the chambers can be easily adjusted to allow comfortable resistance and conformity to a wide range of body lengths, weights, and shapes. Preferred embodiments have insulative, self inflating elements, comprising low-density, open-celled, flexible foam in a rectangular configuration, in a thin-walled cylindrical configuration, and in an arced configuration determined by an adhered heat-reflective plastic film.

20 Claims, 15 Drawing Figures

PLAN VIEW FOAM MATTRESS WITH INTER-CONNECTING CHAMBERS

SIDE VIEW OF FIG. 1

CROSS SECTION VIEW OF FIG. 1 WITH SUPINE OF SLEEPER

CROSS SECTION VIEW OF FIG. 1 WITH SLEEPER ON SIDE

SEMI-CYLINDRICAL FOAM ELEMENT FOR CHAMBERS OF FIG. 1

CYLINDRICAL FOAM ELEMENT FOR CHAMBERS OF FIG. 1

CYLINDRICAL FOAM ELEMENT IN CHAMBER

SEMI-CYLINDRICAL FOAM ELEMENT IN CHAMBER

PLAN VIEW INFLATABLE MATTRESS WITH NON-INFLATABLE SECTIONS

CROSS SECTIONAL SIDE VIEW MATTRESS WITH FOAM SURROUNDING CHAMBERS

INFLATABLE MATTRESS WITH SINGLE VALVE TOP VIEW

TOP VIEW INFLATABLE MATTRESS WITH 4 SEPARATE COMPARTMENTS

TOP VIEW
INFLATABLE
MATTRESS WITH
SIX SEPARATE
CHAMBERS

SIDE VIEW
MATTRESS WITH
SEPARATE
PADDED ELEMENTS

SIDE VIEW
MATTRESS
COMPOSED OF
HOMOGENEOUS
RESILENT
MATERIAL

MATTRESS WHICH CONFORMS TO BODY PROFILE

This patent issued from an application which is a continuation of application Ser. No. 06/542,763, filed 10-17-1983, now abandoned.

BACKGROUND

1. Field of Invention

This invention relates generally to mattresses, specifically to a mattress which conforms to the body shape of a user. The inventive mattress provides improved conformability to varied body sizes, weights, and positions. The preferred embodiments have insulative, self-inflating elements within the mattress.

2. Discussion of Prior Art

There are many types of mattresses which have been designed to give a reasonable degree of comfort to users. The "comfort" principle behind all mattresses is the same, however: the more the mattress conforms to the natural curves of the body which it supports, the more comfortable the mattress feels.

Heretofore, mattresses have had four primary constructions.

One of the oldest constructions is a fabric sack stuffed with a soft, yielding material of relatively low resilience, such as cotton or feathers. A principal disadvantage of this type of mattress is that the stuffing tends to pack, developing cavities and bumps, so that it needs to frequently be shaken, pummelled, and forced back into shape.

Another, more recently developed type of construction comprises a relatively flat, flexible surface backed by a resilient yielding structure or medium which offers smoothly increasing resistance as the surface is deformed. Examples of this type are innerspring mattresses, flexible open celled foam mattresses, and various types of air mattresses. A disadvantage with these mattresses is that they cannot completely conform to body profiles, but instead have reduced support for the upwardly-concave areas, such as the lumbar (small-of-the-back) region, and overly firm support or pressure at the downwardly-convex regions, such as the buttocks and upper back. This necessitates offering innerspring mattresses, for instance, in soft, medium and firm grades to provide a partial compromise for the user.

Still another type of construction comprises a mattress which is mechanically deformed by linkages, pneumatic, or hydraulic means, thereby to conform to a preferred body position. Examples of this type are "hospital" beds which elevate the upper body and the knees. These beds tend to be heavy, expensive, and only minimally comfortable to a user in any position other than supine.

Yet another type of construction comprises various forms of water filled, water and foam filled, or liquid and floating body filled mattresses. These attempt to float the body on a very flexible surface backed by a liquid medium; this gives extremely uniform support, and has a resistance to deformation which increases very gradually. While the best of these mattresses can approach the ideal in comfortable, body profile conforming support, they have a number of disadvantages. They are heavy, require periodic maintenance, require an electrical heater, can spill if a puncture occurs, and tend to produce excessive wave motions which can be disturbing.

The last type of construction comprises a mattress with depressions and slots for the abdomen, breast, and face of a prone sleeper. While the addition of removeable elements, or inflatable/deflatable sections, allows such a mattress to be used for positions other than the prone, it is inconvenient to adjust, and is no more conformable to body contours, in the supine or side positions, than are other flat, resilient mattresses.

While the foregoing constructions can be utilized by the best designers to make mattresses having a degree of comfort, the resulting products, as stated, are usually heavy, bulky, intricate, expensive, difficult to fabricate, and/or easily damaged. Also, none of these mattresses offer adequate support of the head, with support for the neck and a comfortable hollow for the shoulder, when the user is lying on his or her side. Thus a separate pillow is required, but even this provides less-than-ideal support.

OBJECTS

Accordingly several objects of this invention are to offer a superior mattress for supporting the natural curves of a reclining body, to provide a mattress which self-adjusts to various body sizes, weights, and positions, to provide a mattress which supports the head while offering a comfortable hollow for the shoulder, and to accomplish this in a light, simple, and inexpensive construction. Further objects and advantages will become apparent from a consideration of the drawings and ensuing description thereof.

DRAWINGS

Figure 3:
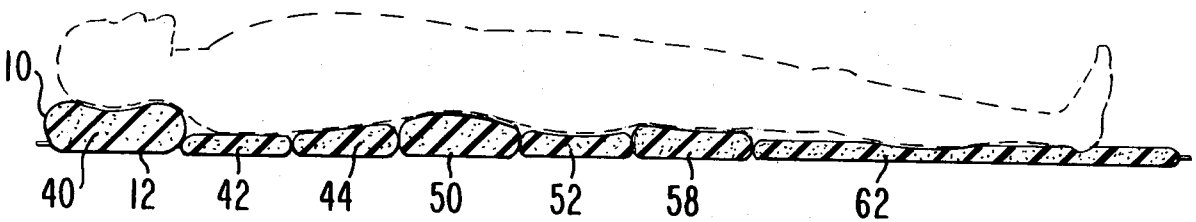
FIG. 3 is a cross-sectional side view of this embodiment with a person lying in the supine position.
Figure 4:
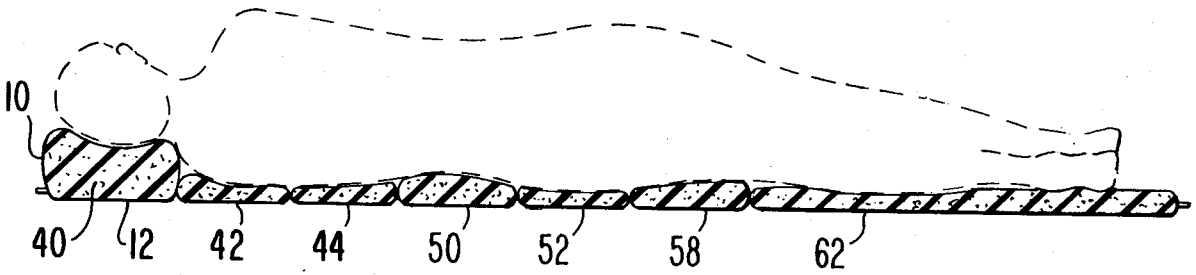
FIG. 4 is a cross-sectional side view of this embodiment with a person lying on his or her side.
Figure 6:
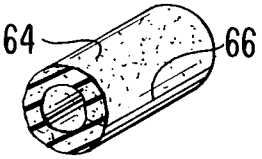
Figure 5A:
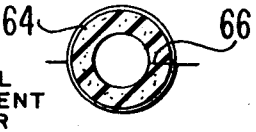

FIG. 5*a* is a cross-sectional side view, and FIG. 6 a perspective view, of an insulating, self-inflating element, employing low-density, open-celled, flexible urethane foam, and alternatively used in the mattress of FIGS. 1–4.

Figure 7:
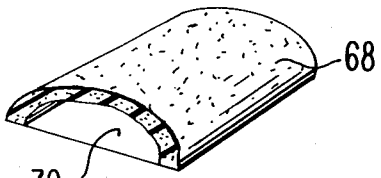
Figure 5B:
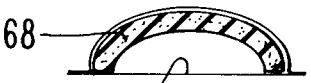

FIG. 5*b* is a cross-sectional side view, and FIG. 7 a perspective view, of another insulating, self-inflating element, employing low-density, open-celled, flexible urethane foam and aluminized plastic film, and alternatively used in the mattress of FIGS. 1–4.

Figure 8:
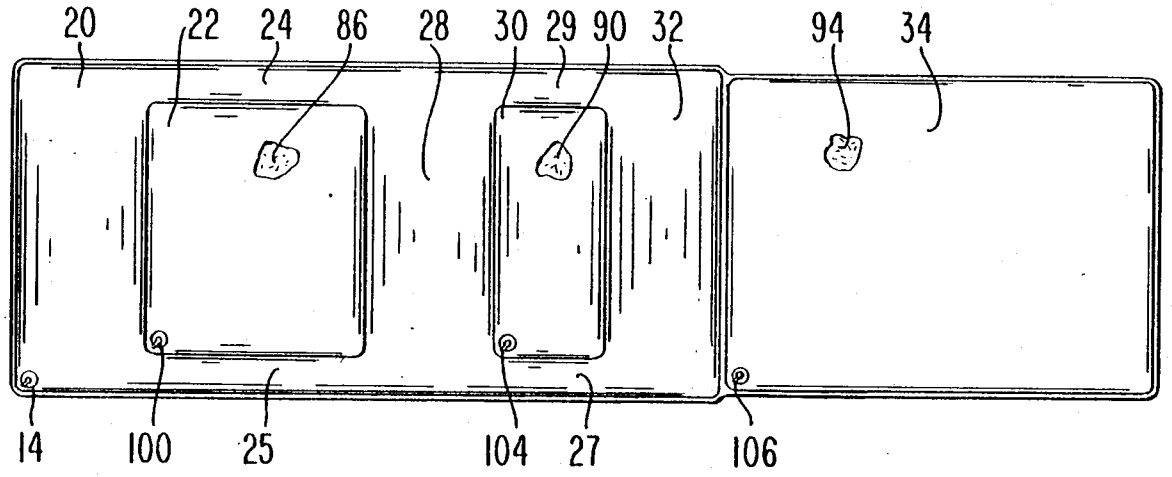

FIG. 8 is a top view of another embodiment, employing inflatable interconnected chambers, and non-inflatable chambers containing firm flexible foam.

Figure 9:
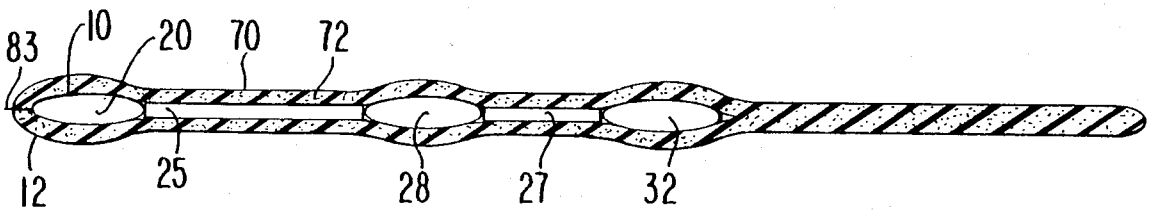

FIG. 9 is a cross sectional side view of an embodiment of the invention employing interconnected chambers embedded in a foam element.

Figure 10:
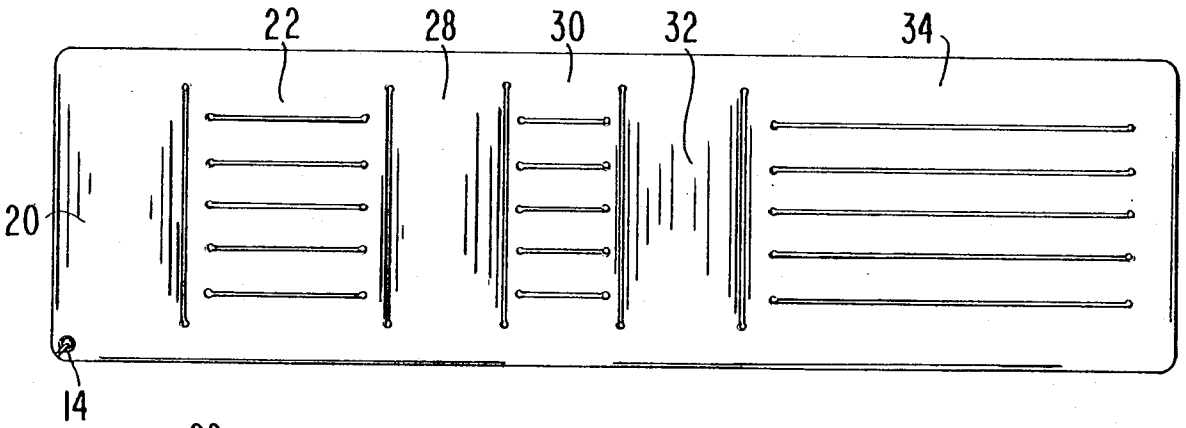

FIG. 10 is a top view of an inflatable embodiment, employing regions defined by heat seals within a single chamber, said regions functioning to some degree as separate chambers.

Figure 11:
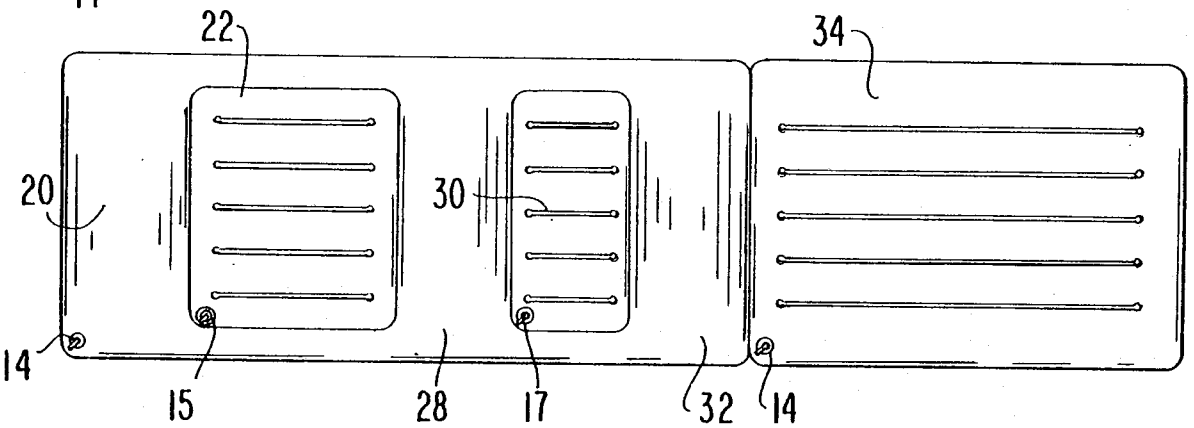

FIG. 11 is a top view of an inflatable mattress employing three interconnected chambers and three separate chambers.

Figure 12:
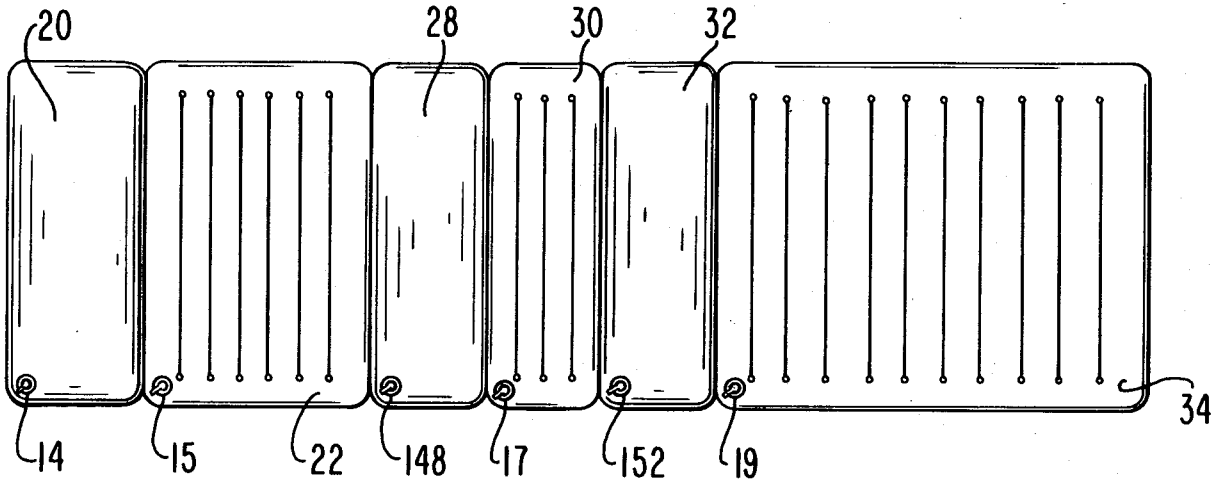

FIG. 12 is a top view of an inflatable matress employing six separate chambers.

Figure 13:
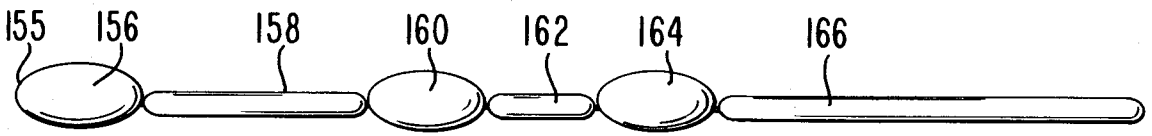

FIG. 13 is a top view of a non-inflatable embodiment employing six resilient elements.

Figure 14:
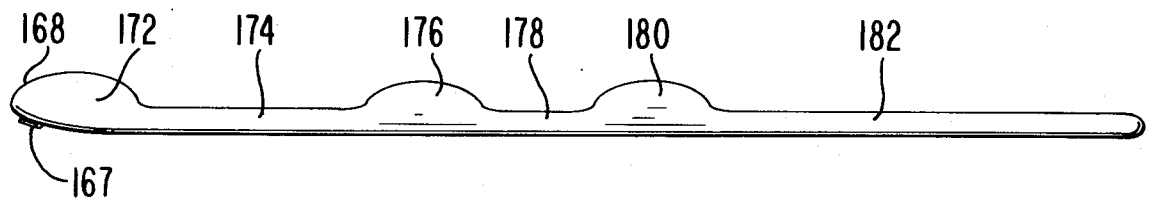

FIG. 14 is a top view of a mattress which can be inflatable, employing a homogeneous core of soft open-celled flexible foam and an adhered cover or coating, or which, alternatively, can be non-inflatable, employing a homogeneous resilient material encased in a cover or coating.

DESCRIPTION MATTRESS WITH SELF-INFLATING ELEMENTS—FIGS. 1-4

Figure 1:
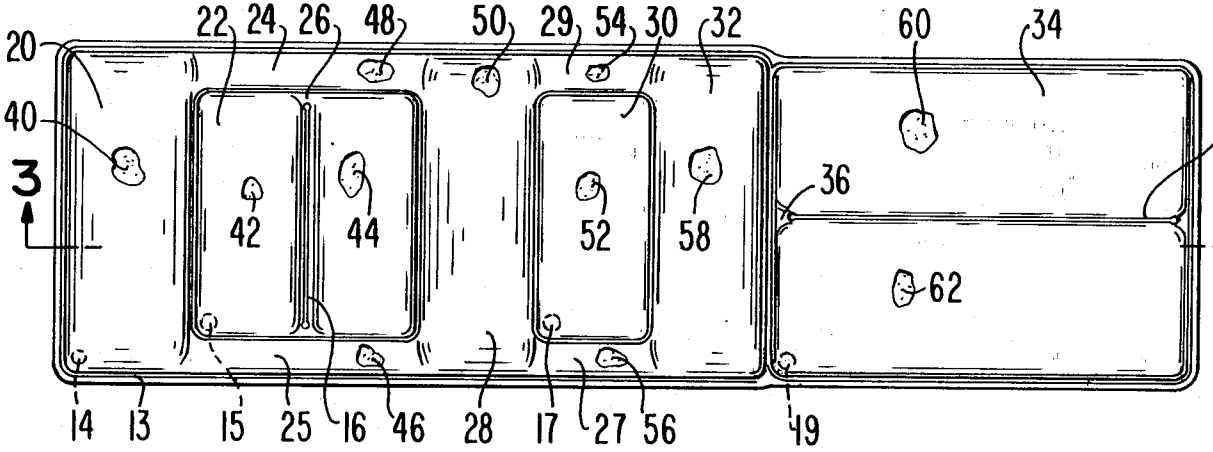
FIG. 1 is a top view of a preferred embodiment of this mattress, employing insulative, self inflating elements, and with three interconnected compartments or chambers.
Figure 2:
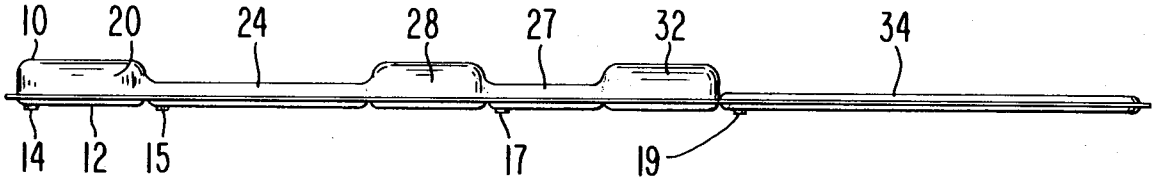
FIG. 2 is a side view of this same embodiment.

The embodiment of the invention shown in FIGS. 1, 2, 3, and 4 comprises upper and lower sheets of heat-sealable, fluid-impermeable air tight fabric 10 and 12. These are sealed together to form interconnected raised (convex) hermetically - sealed compartments or chambers 20, 28, and 32, connected by passages 24, 25, 27, and 29. Chambers 22, 30, and 34 are isolated from the raised compartments. All chambers contain generally-rectangular blocks or pieces of low-density, open-celled, flexible urethane foam. Upper sheet 10 is cut away to show the foam at 40, 42, 44, 46, 48, 50, 52, 54, 56, 58, 60, and 62. Four manually-operated air valves 14, 15, 17, and 19 are sealed to and penetrate the bottom fabric 11 in four of the chambers, 20, 22, 30, and 34. (FIGS. 1 and 2). The valves consist of relatively small, flexible plastic units situated in upper outside corners of the chambers, where it is unlikely that a user's body will bear down on them.

Head chamber 20 is 23 cm long by 10 cm thick by 58 cm wide, and has valve 14 in an upper corner, on the underside of chamber 20. This chamber cushions the neck and head of a supine body (FIGS. 3 and 4). (All dimensions approximate.)

Passages 24 and 25 are about 6 cm wide by 4 cm thick by 40 cm long, and enable air to flow from head chamber 20 to lumbar chamber 28, and vice-versa (FIG. 1).

Back chamber 22 has a transverse dimension of 44 cm, a thickness of 4 cm, and a longitudinal dimension of 38 cm. Valve 15 is located in an upper corner, on the underside of chamber 22. Chamber 22 contains two pieces of foam 42 and 44, separated by a center seal 16. An opening 26 is provided around the end of this seal. This chamber supports the upper torso of a supine body (FIGS. 3 and 4).

Lumbar chamber 28 is 20 cm long by 7.5 cm thick by 58 cm wide. The upper surface of this chamber is convex and supports the lumbar region with uniform pressure over substantially the entire area (FIG. 3).

Passages 27 and 29 are 6 cm wide by 4 cm thick by 20 cm long, and enable air to flow from lumbar chamber 28 to thigh chamber 32, and vice versa (FIG. 1).

Seat chamber 30 is 20 cm long by 7.5 cm thick by 44 cm wide, and has valve 17 in an upper corner, on its underside. This chamber supports the buttocks (FIG. 3 and 4).

Thigh chamber 32 is 20 cm long by 7.5 cm thick by 58 cm wide. This chamber is convex upward and supports the lower region of the buttocks and upper region of the thighs with uniform pressure over a substantial area thereof (FIG. 3).

Leg chamber 34 is 78 cm long by 2.5 cm thick by 58 cm wide, and has valve 19 in an upper corner, therebeneath. It contains two pieces of foam 60 and 62, separated by a seal 35, with an opening 36 around the upper end of this seal. Seals 35 and 16 have enlarged, rounded terminations; these reduce local stresses, during pressurization, on the heat sealed fabrics. Chamber 34 supports the legs and feet (FIG. 3 and 4).

Heat seal 13 runs around the entire perimeter of the mattress, and also separates thigh chamber 32 from leg chamber 34 (FIG. 1).

The embodiment of FIGS. 1 to 4 is preferred as a portable mattress for camping or occasional use. It has the advantages of being light, self-inflatable, collapsible to small size, and adjustable to a wide range of body sizes.

Cylindrical Self-inflating Element—FIGS. 5*a*, 6

FIGS. 5*a* and 6 show an embodiment of an insulative self-inflating element, employing a thin flat sheet of low-density, open-celled, flexible urethane foam 64, adhered together on two edges to form a seam 66. This turns flat sheet 64 into a resilient, springy cylinder, which, when flattened, tends to return to its round shape. Such a cylindrical insulative self-inflating element may be used in chambers 20, 28, and 32 in lieu of foam blocks 40, 50, and 58. These cylindrical elements are lighter and less expensive, if efficiently manufactured, than foam blocks. However the cylinders have slightly less insulative value than a solid block, and are more difficult to manufacture.

Heat-reflecting Self-inflating Element—FIGS. 5*b*, 7

FIGS. 5*b* and 7 show another insulative self-inflating element. The element is composed of a thin sheet of low-density, open-celled, flexible urethane foam 68 and an infrared radiation-reflecting bottom film 70, e. g., of aluminized polyethylene plastic. Film 70 is bonded to the edges of foam sheet 68 by adhesives such as foam bonding contact adhesive, and holds sheet 68 in an arc. Such an element may be used in all chambers of the embodiment shown in FIGS. 1 through 4. The advantages of this element over the cylindrical element of FIGS. 5 and 6 are lighter weight and less expense when manufactured efficiently. However it is more difficult to manufacture, and must be carefully positioned and adhered within the chambers of a mattress.

Inflated and Non-inflated Chambers—FIG. 8

FIG. 8 shows another embodiment of the invention. Two sheets of heat sealable, air-tight fabric are sealed together to form chambers and passages, as in the first-described embodiment (FIGS. 1–4). However, head chamber 20, lumbar chamber 28, thigh chamber 32, and passages 24, 25, 27, and 29 do not contain insulative, self-inflating elements, but instead are air-inflated through valve 14. Alternatively, these chambers and passages may have the insulative self-inflating elements of FIGS. 5, 6, or 7, or other insulative and/or self-inflating elements. For instance, an insulative, non-self-inflating filling, such as polyester wool, which has lower weight than open-celled flexible foam, may be used. Also, infrared radiation reflecting film may be adhered to the heat-sealable sheets comprising the body of the mattress. Back chamber 22 and seat chamber 30 are not air tight, and contain 2.5 cm thick sheets of closed cell or very stiff open-celled foam blocks 86 and 90. Leg chamber 34 contains a 1.5 cm thick sheet of a softer open celled foam 94, which nonetheless has adequate support for the legs. Rather than valves, these chambers have simple grommeted openings 100, 104, and 106.

The advantages of this embodiment over that of FIGS. 1–4 are that it has fewer inflated chambers and fewer inflation valves, and is therefore less expensive to manufacture. However the noninflated chambers cannot be adjusted to the specific preferences of each user.

Mattress with Chambers Inside Foam Element—FIG. 9

FIG. 9 shows a cross-sectional, side view of another preferred embodiment of the invention. A low-density, open-celled, flexible urethane foam self-inflating element 72 is covered by fabric or coating 70, and has embedded within it two sheets of heat-sealable, air-tight fabric 10 and 12. These sheets are sealed together to form head chamber 20, passage 25, lumbar chamber 28, passage 27, and thigh chamber 32. Valve 83, in combination with self-inflating element 72, allows the chambers and passages to automatically fill with air or liquid.

The advantages of this embodiment are that it has a greater range of adjustment than the other embodiments, is softer and thicker, and offers less resistance across the abdomen to a figure lying prone. The only disadvantages in respect to the other preferred embodiment of FIGS. 1–4 is that it is bulkier and more complex to manufacture. However, because of its greater comfort and simpler adjustability, it may be preferred as a conventional, or non-portable, mattress.

Inflatable without Separated Chambers—FIG. 10

FIG. 10 shows an inflatable mattress, without self-inflating or supportive foam elements, with "chambers," sections, or regions defined by straight bar seals, and with a single valve 14. Due to the spacing of the seals, the mattress has effective support regions comprising convex head region 20, flat back region 22, convex lumbar region 28, flat seat region 30, convex thigh region 32, and flat leg region 34. The bar seals, and those in all following embodiments, have enlarged and rounded terminations, to reduce stresses at these points, during pressurization, on the fabrics which are heat sealed together. This embodiment has the advantage of being very light, simple, and inexpensive to manufacture. However, it is not self-inflating, has less effective thermal insulation and less adjustability than the embodiment of FIGS. 1–4, and tends to "bottom out," allowing the user's body to contact the ground when the mattress is not fully inflated.

Inflatable Mattress with Separate Chambers—FIG. 11

FIG. 11 shows another configuration of inflatable mattress, without self-inflating or supportive foam elements. This mattress has chambers and passages similar to the embodiment of FIGS. 1 through 4, with air valves 14, 15, 17, and 19. Back chamber 22, seat chamber 30, and leg chamber 34 have closely spaced seals which, under inflation, form connected tubular support surfaces similar to those of conventional, tubular, air mattresses. This embodiment has an advantage over that of FIG. 10 in adjustability due to the separate chambers, but similarly is not self-inflating, and has less thermal insulation than the embodiment of FIGS. 1–4.

Mattress without Interconnecting Chambers—FIG. 12

FIG. 12 shows yet another configuration of inflatable mattress, which may or may not have insulative and/or selfinflating elements. This mattress differs significantly from the above-detailed embodiments in that there are no interconnected chambers. This embodiment may be preferred if the mattress is to serve double duty as an emergency flotation device. In this use, the mattress would retain more buoyancy, in the event of one or more punctures, than the previously described embodiments.

Non-inflatable with Separate Segments—FIG. 13

FIG. 13 shows an embodiment of the invention which is not inflatable. Sections Segments of the mattress are interconnected by, and encased in, a fabric 155. Head segment 156 is relatively soft and yielding, back segment 158 is relatively firm, lumbar segment 160 is soft and yielding, seat segment 162 is quite firm, thigh segment 164 is soft and yielding, and leg segment 166 is relatively firm. This embodiment may be preferred where only the supine position is assumed, and the reliability of a non-inflated mat or cushion is desired. The fabric 155 may be water-tight to allow use of the cushion as a buoyant float.

Inflatable or Non-inflatable Mattress with Homogeneous Support element—FIG. 14

FIG. 14 shows another embodiment of the invention which comprises a single piece of foam 170 or other resilient material, which is cut, molded, or otherwise shaped to provide the following respective regions: head region 170, back region 174, lumbar region 176, seat region 178, thigh region 180, and leg region 182. The inflatable embodiment comprises a shaped homogeneous core of low-density, open-celled, flexible urethane foam, with an air tight coating or fabric adhered to the entire surface. The noninflatable embodiment may or may not include a fabric cover or coating 168. This embodiment may be preferred for a supine-only position, where a configuration which is simpler than that of FIG. 13 is desired.

Operation—FIGS. 1–4

The mattresses of this invention utilize conformable chambers which follow the natural curves of the body. Within the preferred embodiments, there are adjustable, interconnected chambers with self-inflating means.

In the embodiment shown in FIGS. 1 through 4, three of these chambers—head chamber 20, lumbar chamber 28, and thigh chamber 32—are interconnected, and have convex upper surfaces under the neck and head, under the small of the back, and under the upper thighs, as shown in FIGS. 2, 3, and 4.

Foam pieces 40, 42, 44, 46, 48, 50, 52, 54, 56, 58, 60, and 62 in each chamber serve as thermally-insulative, self-inflating elements. The foam pieces aid insulation by reducing the convective circulation of air from hot to cold, and by impeding the radiative heat losses.

The mattress can be collapsed or reduced in volume for storage. This is accomplished by opening all valves and rolling the mattress into a tight cylinder, starting with the leg end. This collapses the contained foam pieces, driving the air out of them. The valves are then closed, and atmospheric pressure on fabric sheets 10 and 11 keeps the foam from re-expanding. When the mattress is to be used, the valves are opened, and the foam pieces will self-expand, drawing air into the chambers and passages, where it resides in the interstices of the foam.

Head chamber 20, lumbar chamber 28, and thigh chamber 32 are approximately three times as thick or high as back chamber 22, seat chamber 30, and leg chamber 34.

As shown in FIG. 1, the mattress is elongated; its length is over twice its width. As also shown in FIG. 1, chambers 20, 28, and 32 are each elongated, in a direction perpendicular to the direction of elongation of the mattress, so that their lengths are at least twice their widths, their widths being all about equal in dimension. As shown in FIG. 2, back chamber 22 provides a recess or concave area, between head chamber 20 and lumbar chamber 28, which is substantially longer (about twice as long), in the direction of elongation of the mattress, than the width of either head chamber 20 or lumbar chamber 28 so as to accommodate the upper back area of a user of predetermined size, as shown in FIG. 3. Seat chamber 27 provides a recess or concave area, between lumbar chamber 28 and thigh chamber 32, which is about as long, in the direction of elongation of the mattress, than the width of either lumbar chamber 28 or thigh chamber 28 so as to accommodate the buttocks of a user of predetermined size, as also shown in FIG. 3. Leg chamber 34 provides a recess or concave area, below thigh chamber 32, which is substantially longer (over three times as long), in the direction of elongation of the mattress, than the width of thigh chamber 28 so as to accommodate the legs of a user of predetermined size, as also shown in FIG. 3. As shown in FIGS. 2, 9, 13, and 14, the thickness of each portion of the mattress between its raised portions or chambers 20, 28, and 32 is less than the width of each of these raised portions.

When a person using the mattress reclines on his or her back (FIG. 3), this height difference allows head chamber 20 to support the head and hold the neck supported in a natural curvature. Lumbar chamber 28 supports the concavity of the lower back in a natural curvature, and thigh chamber 32 supports the thighs at a comfortable level above the buttocks.

Air pressure in these chambers can be varied by filling or deflating them with valves 14, 15, 17, and 19, thereby to fit the contours of the user's body. The upwardly-convex chambers, comprising head chamber 20, lumbar chamber 28, and thigh chamber 32, together with the thinner and flatter, though nonetheless variable-height chambers 22, 30, and 34, effectively provide a "depth" equivalent to a much thicker standard or flat mattress. This feeling of depth is achieved by the upwardly-convex chambers conforming to and supporting the body's concave-up regions, coupled with the adjusting of air pressure in the chambers to achieve a sensation of equalized support or resistance for substantially the entire body.

This sensation of equalized support is easily achieved as follows:

Valves 14, 15, 17, and 19 are opened to allow the mattress to self-inflate. Back chamber 22, seat chamber 30, and leg chamber 34 self-inflate to a thickness which prevents an average range of users' bodies from "bottoming out," or contacting the ground or surface beneath the mattress. Similarly, head chamber 20, lumbar chamber 28, and thigh chamber 32 self-inflate to a height which offers support for the concave-up regions in an average range of user's body types.

On first use, the user closes all valves after the mattress self-inflates, and lies down on it in a variety of positions to test conformity. He or she then adds or vents air until an optimum comfort is achieved. On subsequent deployments, the user will estimate an approximate addition or venting prior to closing each valve. In testing with users of various body types, the "comfort range" seems sufficiently broad to allow an easy estimation for re-use.

The conformity and equalized support achieved by this configuration is a very significant factor for comfort. This can be especially appreciated when comparing a mattress of this design with a customary camper's mattress, which is thin and flat.

Back chamber 22 and leg chamber 34 have test seals 17 and 35 down the centers, to reduce billowing and consequent loss of air pressure support when the user's body does not cover a substantial area of each chamber.

Interconnection of the head chamber 30, lumbar chamber 28, and thigh chamber 32, by the passages 24, 25, 27, and 29, allows air to flow between the chambers. This offers several advantages:

First, the interconnection allows pressure in the three chambers to equalize, resulting in equal support or resistance per unit of surface to three sensitive regions of the body, the neck and head, lower back, and thighs. This equalized support is a significant subjective comfort factor.

Second, the interconnection allows adjustable support for these regions of the body by means of a single valve 14. By adding or venting air through valve 14, the user can adjust support pressure or resistance in chambers 20, 28, and 32.

Third, the interconnection allows the height or loft of head chamber 20 to change supportively as the user shifts from lying face up to lying on one side, as shown in FIG. 4. This is caused by the displacement of air from lumbar chamber 28 and thigh chamber 32 into head chamber 20. A further advantage of this increase in height of head chamber 20 when the user lies on his or her side is that, in effect, a "pocket" forms for the shoulder, giving a depth and resulting comfort that the we believe to be unique in mattress design.

An additional advantage brought about by selective adjustment of air volume in the chambers of this mattress is the adjustability in length. It can be appreciated that the inflation of a chamber comprised of flexible air-tight fabric changes its cross section from flat to round. If inflatable mattresses have transverse inflatable chambers, as do the mattresses of FIGS. 1–4, and FIGS. 8, 9, 10, 11, and 12, the longitudinal dimension of these mattresses will decrease as air is added to one or more of the chambers. It can further be appreciated that selective adjustment of the unconnected chambers of the mattress in FIGS. 1–4 and the mattress in FIG. 12 can change the dimension of one section or chamber relative to the others.

Operation—FIG. 6

Thermally insulative elements are necessary in a thin mattress which is to be used outdoors or in unheated tents, vehicles, etc. Insulative self-inflating elements are provided in several embodiments of this invention for two reasons: they serve as thermal insulation to reduce heat loss from the body of a user to the ground or other cold surface, and they eliminate or reduce the effort required to inflate the mattress chambers.

The insulative self-inflating element of FIG. 6 may be preferred to rectangular foam piece. An element of this configuration will have less total material than a solid foam piece for an equivalent volume of inflation in a chamber. We have found that a 2 cm×44 cm×58 cm sheet of low-density, opencelled, flexible urethane foam, when converted into a cylinder, expanded head chamber 20 to the same volume as a 10 cm×23 cm×58 cm piece of solid foam. The cylindrical element of FIG. 6 was therefore approximately 2.5 times as effective, per unit of foam, as the solid foam. This element may be advantageously used in head chamber 30, lumbar chamber 28, and thigh chamber 32. Back chamber 22, seat chamber 30, and leg chamber 34 do not have sufficient thickness and resultant volume to make use of a cylindrical element advantageous over a solid sheet of foam.

Operation—FIG. 7

The insulative self-inflating element of FIG. 7 uses less equivalent foam per volume of inflation than the cylindrical element of FIG. 6. When tested, foam piece 68, with half the volume of foam piece 64 of FIG. 6, inflated head chamber 20 to approximately ⅔ the volume achieved by the cylindrical element. It was therefore 1.3 times as effective per unit of foam. This element also has an infrared radiation reflecting component, aluminized film 70, which causes it to have twice the insulative value of an equivalent thickness of foam.

The element of FIG. 7 may be advantageously used in all chambers of the mattress of FIGS. 1–4. In head chamber 20, lumbar chamber 28, and thigh chamber 32, both inflative and insulative features are valuable. In back chamber 22, seat chamber 30, and leg chamber 34, the insulative feature of this element is valuable.

Operation—FIG. 8

The embodiment of FIG. 8 is similar to that of FIGS. 1–4, but is simplified by a reduction in the number of inflated chambers. Back chamber 22 and seat chamber 30 rely on very firm foams rather than air inflation to prevent the back and buttocks from "bottoming out." Leg chamber 34 may contain a softer foam, since the weight per unit area of the legs is normally less than that of the torso. None of these three chambers require an inflation valve, as they do not rely on inflation pressure. This embodiment does not have the range of adjustment of the embodiment of FIGS. 1–4, but is simpler and less expensive to manufacture.

Operation —FIG. 9

The embodiment shown in FIG. 9 utilizes the same principles as the mattress of FIGS. 1–4, although the arrangement of elements is considerably different. Insulative self-inflating element 72 surrounds and is bonded to the outside of chambers and passages formed by heat-sealing air-tight fabrics or films 10 and 12. While the self-inflating elements of the embodiment in FIGS. 1–4 are inside the chambers and passages, and function by expanding and being compressed, the mattress of FIG. 8 relies on external self-inflating element 72 to pull on the outer surfaces of the chambers and passages, reducing the pressure inside if they have been previously collapsed. Air or liquid is then drawn in through valve 83.

In a preferred embodiment of this mattress, valve 83 automatically passes air or liquid into the chambers of the mattress, and passes air or fluid out of the chambers only when manually activated. Self-inflating element 72 of this mattress is designed to overinflate the chambers. A user then lies down on the mattress, and opens valve 83. His or her weight drives fluid out of the mattress, and the valve is closed when a comfortable volume of fluid remains in the chambers. This embodiment has the adjustable body profile conforming elements of other embodiments, i.e., head chamber 20, passage 25, lumbar chamber 28, passage 27, and thigh chamber 32.

Operation—FIG. 10

The embodiment of FIG. 10 is an inflatable mattress with no foam or other insulative or self-inflating elements, and no separate chambers. The range of adjustment of such a mattress is limited by its thickness. If too thin, the back and buttocks tend to bottom out at lower inflation pressures. This mattress may be the least expensive to manufacture in large quantities. However, it requires a large volume of pressurized air for inflation and has less effective thermal insulation characteristics.

Operation—FIG. 11

The mattress of FIG. 11 can have a wider range of adjustment than that of FIG. 10, due to the separate inflatable chambers 22, 30, and 34. There is also less tnedency for a user to "bottom out" on this mattress. For instance, it can be appreciated that when a user reclines on the mattress, back chamber 22 and seat chamber 30 will be compressed without communication to the whole mattress, as occurs in the embodiment of FIG. 10. This results in a steeper pressure gradient in these chambers than in equivalent regions in FIG. 10, or a greater rise in pressure/resistance under deformation.

Operation—FIG. 12

The mattress of FIG. 12 comprises six separately inflatable chambers or chambers. It can be adjusted for comfort in a particular reclining position, such as lying supine, but may not be optimum for another position, such as lying on one's side, without further inflation and deflation of various chambers. This is due to the limited volume of each chamber. It can be appreciated, for instance, that, due to the lack of interconnection between head chamber 20, lumbar chamber 28, and thigh chamber 32, head chamber 20 will not change volume and so height when one shifts from lying on one's back to lying on one's side, and vice versa. Also, lumbar chamber 28 may have a comfortable, supportive height when one is reclining supine, but may be a very uncomfortable bulge when one is prone. The separately inflated chambers can be useful where the user is generally supine, as on a lounge chair, where the lightness of an inflatable is desirable, or where reliable buoyancy is necessary, as in a mat that also serves as an emergency float.

Operation—FIG. 13

The mattress of FIG. 13 is similar to that of FIG. 12 in that it has separate compartments, but, since it has no inflatable elements, it would not have the adjustability of the mattress of FIG. 12. However, such a design is very useful where the user is generally supine, as on a chaise lounge, or in use as a pool float, where the buildup of resistance would be moderated by the tendency to sink into the supporting medium, and where the simplicity of a non-inflatable mattress is preferable over the lightness of an inflatable such as that of FIG. 12.

Operation—FIG. 14

The homogeneous construction of FIG. 14 can be employed in either an inflatable or non-inflatable embodiment. As an inflatable, a very soft, low-density, open-celled, flexible urethane foam 170 has air-tight coating or fabric 168 bonded or adhered to it.

Adhesion of an air-tight skin to substantially the entire surface of the foam core is necessary to prevent "billowing." Billowing occurs when an air-tight covering or skin is not bonded to a contained core: when the inflatable is pressurized or deformed, increased air pressure causes the covering to separate from the core and assume a rounded contour. It can be appreciated that if an air-tight skin or covering surrounds a flat, flexible core, under inflation the skin will tend to assume a rounded cross-section. If the skin is not bonded to the core, an increase in volume of the inflatable will result. If the contained air in an inflatable of generally flat configuration, such as a mattress, has no greater volume than the unattached core, the air will furnish no cushioning support, due to billowing, or an unrestrained increase in the volume of the inflatable with very small pressure change. When the air-tight skin is bonded to the core, billowing does not occur, and support pressure within the inflatable mattress rises in direct proportion to the deformation of the mattress.

Valve 167 penetrates skin or covering 168. The mattress self-inflates, and can be further pressurized as desired. This embodiment has the advantage of being simple to manufacture, has only a single inflation valve, and can be deflated and rolled into a cylinder for storage. The use of a soft foam 170 improves the conformity of this mattress or pad to a variety of body positions, as the foam offers little resistance when deformed. However, head region 172 will not vary in height with various positions as with the mattress of FIGS. 1–4, and there may be a tendency for the back and buttocks to bottom out under low inflation pressures, as with the single-valve inflatable mattress of FIG. 10.

As a non-inflatable mattress, pad, or cushion, a firm flexible foam or other resilient material 170 is enclosed by a fabric or cover 168, and has no valve 167. As this embodiment has limited conformity to a variety of body positions as do the mattresses in FIGS. 12 & 13, it is best suited for comfort in the supine position. Due to its simplicity, it will have a low manufacturing cost, and is therefore very attractive for limited applications, such as in a chaise lounge, where the user reclines in the supine position.

While the above descriptions contain many specificities, these should not be construed as limitations on the scope of the invention, but rather as an exemplification of preferred embodiments thereof. Many other variations are possible, for example having single passages between chambers, having the seat chamber connect to the lumbar chamber, and other variations not limited to those mentioned here.

For instance, a separate chamber can be provided under the knees, which interconnects with a chamber at the foot. When the user is supine, the space behind the knees is filled and supported. When the user turns on his or her side, fluid moves out of the knee chamber as it is pressed by the side of the knee or foreleg.

Another example would be a mattress similar to that described, with an additional chamber at the head end. This would cradle the neck and head over a wider range of body types, and allow more air to transfer from the head and neck chambers to the small of back and thigh chambers.

Yet another example would be the addition of further interconnected chambers and valves to block air flow between selected chambers. This could include the collapsing or expanding of chambers to vary the length of the mattress.

Still another example would be the use of closed chambers and interconnected, dimensioned chambers in a thicker mattress, including one with conventional I-beam construction, longitudinal inflatable elements, or water compartments.

In a thicker mattress, the chambers could be deeper and more resilient than those shown. There could be a contoured pad beneath the chambers, said pad having a concave bottom surface beneath the lumbar chamber to allow greater depth for the abdomen of a prone individual. Also, there could be a sloping depression from the calves to the feet, allow these portions of the body more comfort, especially when blankets or covers are draped over them.

Also, it can be appreciated that an embodiment of this mattress can be used as a water float or as the padding or upholstery of a chair, auto seat, couch, chaise lounge, a convertible (sitting, lying, or lounging) furniture piece, etc.

Accordingly, the full scope of the invention should be determined not by the embodiments illustrated, but by the appended claims and their legal equivalents.

We claim:

1. A mattress for camping or the like, comprising:

an elongated body having opposed upper and lower major surfaces, the length of said body being at least twice its width, said body having opposed longitudinal ends, one end being a head end and the opposite end being a foot end, said upper and lower major surfaces of said mattress being separated by means which render said mattress springably deformable, said upper major surface of said mattress having a plurality of separate raised portions which each project upwardly from the remainder of said upper major surface, the remainder of said upper major surface thereby constituting a plurality of portions which are recessed with respect to and which separate said separate raised portions such that said separate raised portions and said recessed portions are disposed in an alternating sequence from said head end to said foot end of said mattress, said raised portions each being elongated in a direction perpendicular to the direction of elongation of said mattress, the length of each of said raised portions being at least twice its width, the widths of all of said raised portions being substantially equal, the width of each of said raised portions being greater than the thickness of said mattress, as measured between the remainder of said upper surface and said lower major surface of said mattress, a first of said raised portions being adjacent said head end of said mattress, a first of said recessed portions extending toward said foot end of said mattress from said first raised portion and being recessed with respect to said first raised portion, the width of said first recessed portion being greater than the width of said first raised portion, a second of said raised portions extending toward said foot end of said mattress from said first recessed portion and being elevated with respect to said first recessed portion, the width of said second raised portion being less than the width of said first recessed portion, a second of said recessed portions extending toward said foot end of said mattress from said second raised portion and being recessed with respect to said second raised portion, a third of said raised portions extending toward said foot end of said mattress from said second recessed portion and being elevated with respect to said second recessed portion, the width of said third raised portion being less than the width of said first recessed portion, and a third of said recessed portions extending to said foot end of said mattress from said third raised portion and being recessed with respect to said third raised portion, the width of said third recessed portion being greater than the width of said first recessed portion.

2. The mattress of claim 1 wherein said separated raised portions are inflatable and intercommunicate with each other so that the pressure in all of said separated raised portions will always be equal, and wherein the portions of said mattress between said separated raised portions are hermetically sealed from and are separately inflatable from said separated raised portions so that the pressure therein can be made different from that within said separated raised portions.

3. The mattress of claim 1 wherein said upper and lower surfaces provide a single hermetically-sealed enclosure, and further including means for filling said enclosure with a fluid.

4. The mattress of claim 3 wherein said means for filling said enclosure with a fluid comprises an air valve.

5. The mattress of claim 3, further including means for interconnecting said separated raised portions so that fluid flow can occur between said separated raised portions.

6. The mattress of claim 1 wherein the volume enclosed by said upper and lower surfaces is filled with a resilient solid material.

7. The mattress of claim 6 wherein said resilient material is a foam material.

8. The mattress of claim 7 wherein said upper and lower surfaces form a hermetically-sealed enclosure which is adhered to substantially the entire surface of said foam material.

9. The mattress of claim 6 wherein said separated raised portions each contain a cylindrical element having an open central core.

10. The mattress claim 6 wherein said separated raised portions each contain a semi-cylindrical resilient element comprising a semi-cylindrical body of resilient material and a flat, flexible member joining the edges of said resilient body so as to form a chord across said semi-cylindrical body.

11. The mattress of claim 1 wherein said upper and lower surfaces of said mattress form a hermetically-sealed enclosure, and further including inflation means for inflating said enclosure.

12. The mattress of claim 1 wherein said mattress is filled with a solid resilient material.

13. The mattress of claim 1 wherein said separated raised portions each comprise upper and lower layers of resilient material having a predetermined thickness and a fluid-filled enclosure separating said upper and lower layers.

14. The mattress of claim 13 wherein said enclosure is filled entirely with a fluid and said upper and lower surfaces are joined together partially around said separated raised portions so as to define said raised portions while allowing fluid to flow between said separated raised portions.

15. The mattress of claim 13 wherein said enclosure is filled entirely with a fluid and said upper and lower surfaces are joined together partially around said separated raised portions so as to define and hermetically isolate said raised portions.

16. The mattress of claim 15 wherein said separated raised portions each have a respective fluid filling means.

17. The mattress of claim 1 wherein said separated raised portions of said mattress and said recessed portions therebetween comprise respective bodies of resilient material, said respective bodies of resilient material being joined together in a serial chain.

18. The mattress of claim 17 wherein said bodies of resilient material are covered by upper and lower layers of flexible sheet material which are joined together between said respective bodies of resilient material.

19. The mattress of claim 1 wherein said separated raised portions of said mattress and said portions of said mattress between said separated raised portions comprise a single, contoured body of resilient material.

20. A mattress for camping or the like, comprising:

an elongated body having opposed upper and lower major surfaces, the length of said body being at least twice its width, said body having opposed longitudinal ends, one end being a head end and the opposite end being a foot end, said upper and lower major surfaces comprising respective sheets of a flexible, fluid-impermeable material, said upper and lower sheets of fluid-impermeable material being joined together at their edges to form the perimeter of said mattress, said upper and lower major surfaces of said mattress being separated by means which render said mattress springably deformable, said upper major surface of said mattress having a plurality of separate raised portions which each project upwardly from the remainder of said upper major surface, the remainder of said upper major surface thereby constituting a plurality of portions which are recessed with respect to and which separate said separate raised portions such that said separate raised portions and said recessed portions are disposed in an alternating sequence from said head end to said foot end of said mattress, said separated raised portions being inflatable and intercommunicating with each other so that the pressure in all of said separated raised portions will always be equal, said recessed portions of said mattress between said separated raised portions being hermetically sealed from and separately inflatable from said separated raised portions so that the pressure in said recessed pprtions can be made different from the within said separated raised portions, said raised portions each being elongated in a direction perpendicular to the direction of elongation of said mattress, the length of each of said raised portions being at least twice its width, the widths of all of said raised portions being substantially equal, the width of each of said raised portions being greater than the thickness of said mattress, as measured between the remainder of said upper surface and said lower major surface of said mattress, a first of said raised portions extending from and being adjacent said head end of said mattress, a first of said recessed portions extending toward said foot end of said mattress from said first raised portion and being recessed with respect to said first raised portion, the width of said first recessed portion being greater than the width of said first raised portion, a second of said raised portions extending toward said foot end of said mattress from said first recessed portion and being elevated with respect to said first recessed portion, the width of said second raised portion being less than the width of said first recessed portion, a second of said recessed portions extending toward said foot end of said mattress from said second raised portion and being recessed with respect to said second raised portion, a third of said raised portions extending toward said foot end of said mattress from said second recessed portion and being elevated with respect to said second recessed portion, the width of said third raised portion being less than the width of said first recessed portion, and a third of said recessed portions extending to said foot end of said mattress from said third raised portion and being recessed with respect to said third raised portion, the width of said third recessed portion being greater than the width of said first recessed portion.

* * * * *

UNITED STATES PATENT AND TRADEMARK OFFICE

CERTIFICATE OF CORRECTION

PATENT NO. :4,688,283

DATED : 1987 Aug 25

INVENTOR(S) : T. L. Jacobson and C. P. Hall

It is certified that error appears in the above-identified patent and that said Letters Patent are hereby corrected as shown below:

In abstract page, col. 1, address of Charles P. Hall: change "Conoma County" to —Sonoma County—.

Col. 5, line 61, change "selfinflating" to —self-inflating—.

Signed and Sealed this

Twelfth Day of January, 1988

*Attest:*

*Attesting Officer*

DONALD J. QUIGG

*Commissioner of Patents and Trademarks*